US009409415B2

(12) United States Patent
Kozuma

(10) Patent No.: US 9,409,415 B2
(45) Date of Patent: Aug. 9, 2016

(54) RECORDING APPARATUS AND METHOD FOR TRANSPORTING RECORDED MEDIUM

(71) Applicant: SEIKO EPSON CORPORATION, Tokyo (JP)

(72) Inventor: Itaru Kozuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/643,534

(22) Filed: Mar. 10, 2015

(65) Prior Publication Data

US 2015/0266316 A1 Sep. 24, 2015

(30) Foreign Application Priority Data

Mar. 20, 2014 (JP) ..... 2014-057901

(51) Int. Cl.

| | |
|---|---|
| ***B41J 11/00*** | (2006.01) |
| ***B04B 1/02*** | (2006.01) |
| ***B41J 15/04*** | (2006.01) |
| ***B41J 29/17*** | (2006.01) |
| ***B41J 29/38*** | (2006.01) |
| *B41J 2/165* | (2006.01) |
| *B41J 2/17* | (2006.01) |
| *B41J 15/16* | (2006.01) |

(52) U.S. Cl.

CPC ..... *B41J 11/0015* (2013.01); *B04B 1/02* (2013.01); *B41J 11/007* (2013.01); *B41J 11/0065* (2013.01); *B41J 15/048* (2013.01); *B41J 29/17* (2013.01); *B41J 29/38* (2013.01); *B41J 15/165* (2013.01); *B41J 2002/16591* (2013.01); *B41J 2002/1742* (2013.01)

(58) Field of Classification Search

CPC .. B41J 11/0015; B41J 11/007; B41J 11/0065; B41J 2002/1742; B41J 2002/16591

USPC ..... 347/101

See application file for complete search history.

(56) References Cited

U.S. PATENT DOCUMENTS

| | | | | |
|---|---|---|---|---|
| 5,225,852 | A * | 7/1993 | Uchida | B41J 2/16579 346/104 |
| 6,074,054 | A * | 6/2000 | Katsuyama | 347/104 |
| 6,530,658 | B1 * | 3/2003 | Pham | B41J 29/17 347/104 |
| 7,370,958 | B2 * | 5/2008 | Lee | 347/104 |
| 2009/0097081 | A1 * | 4/2009 | Tabata | B41J 19/205 358/497 |
| 2014/0063122 | A1 | 3/2014 | Kanemoto | |
| 2014/0284177 | A1 * | 9/2014 | Chiba | B41J 11/007 198/497 |

FOREIGN PATENT DOCUMENTS

JP 11-192694 A 7/1999

OTHER PUBLICATIONS

The Extended European Search Report for the corresponding European Application No. 15159606.1 dated Aug. 10, 2015.

* cited by examiner

*Primary Examiner* — Julian Huffman
*Assistant Examiner* — Michael Konczal
(74) *Attorney, Agent, or Firm* — Global IP Counselors, LLP

(57) ABSTRACT

A recording apparatus includes a transportation belt that transports a recorded medium; a washing portion that washes the transportation belt; and a selection unit that selects a transportation mode for transporting the recorded medium from among a washing transportation mode in which the transportation belt is transported while being washed by the washing portion, and a non-washing transportation mode in which the transportation belt is transported without being washed by the washing portion.

9 Claims, 4 Drawing Sheets

RECORDING APPARATUS AND METHOD FOR TRANSPORTING RECORDED MEDIUM

BACKGROUND

1. Technical Field

The present invention relates to a recording apparatus and a method for transporting a recorded medium.

2. Related Art

Heretofore, there have been utilized recording apparatuses in which a recorded medium is transported by a transportation belt. Among such recording apparatuses, there has been utilized a recording apparatus provided with a washing portion for washing the recorded medium. For example, in JP-A-11-192694, there has been disclosed a recording apparatus including an endless belt which transports a recorded medium while being adhesively fixed to the recorded medium, and a washing portion which is used for washing the endless belt and which is provided with a wiping roller having a surrounding face made of a polymeric porous material.

Recently, in such a recording apparatus including a transportation belt for transporting a recorded medium and a washing portion for washing the transportation belt, it has become possible to perform recording in various recording modes. Further, with the advent of such various recording modes, there has been required a recording apparatus capable of transporting the recorded medium in various transportation modes during an operation along with recording as well as during an operation along with no recording. In addition, in JP-A-11-192694 having been cited above, there is no description on such a transportation of the recorded medium in various transportation modes.

SUMMARY

An advantage of some aspects of the invention is that a recording apparatus is provided, which includes a transportation belt for transporting a recorded medium and a washing portion for washing the transportation belt, and which is capable of transporting the recorded medium in various transportation modes.

A recording apparatus according to a first aspect of the invention includes a transportation belt that transports a recorded medium; a washing portion that washes the transportation belt; and a selection unit that selects a transportation mode for transporting the recorded medium from among a washing transportation mode in which the transportation belt is transported while being washed by the washing portion, and a non-washing transportation mode in which the transportation belt is transported without being washed by the washing portion.

A recording apparatus according to a second aspect of the invention is configured to, in the above first aspect, further include a control unit that controls the transportation belt and the washing portion in accordance with a transportation mode selected by the selection unit.

A recording apparatus according to a third aspect of the invention is configured such that, in each of the above first and second aspects, the selection unit selects, as a transportation mode for use in transporting the recorded medium along with no recording operation after a recording operation onto the recorded medium has been brought to a halt, the washing transportation mode or the non-washing transportation mode, whichever has been selected in the recording operation having been brought to a halt.

A recording apparatus according to a fourth aspect of the invention is configured to, in each of the above first to third aspects, further include a feeding portion that feeds the recorded medium to the transportation belt, and allow at least one of the washing transportation mode and the non-washing mode to be executed in combination with any one of two kinds of transportation modes, one being a slack-medium transportation mode in which the recorded medium, which is fed from the feeding portion to the transportation belt, is transported in a slack state, the other one being a tensioned-medium transportation mode in which the recorded medium, which is fed from the feeding portion to the transportation belt, is transported in a state in which a tensile force is applied to the recorded medium.

A recording apparatus according to a fifth aspect of the invention is configured to, in the above fourth aspect, further include a control unit that controls the transportation belt, the washing portion, and the feeding portion in accordance with a transportation mode selected by the selection unit.

A recording apparatus according to a sixth aspect of the invention is configured to, in any one of the above first to fifth aspects, further include a transportation adjustment portion that adjusts a transportation direction of the recorded medium, and allow at least one of the washing transportation mode and the non-washing transportation mode to be executed in combination with any one of two kinds of transportation modes, one being a transportation adjustment mode in which the transportation direction is adjusted by the transportation adjustment portion, the other one being a non-transportation adjustment mode in which the transportation direction is not adjusted by the transportation adjustment portion.

A recording apparatus according to a seventh aspect of the invention is configured to, in the above sixth aspect, further include a control unit that controls the transportation belt, the washing portion, and the transportation adjustment portion in accordance with a transportation mode selected by the selection unit.

A recording apparatus according to an eighth aspect of the invention is configured to, in any one of the above first to seventh aspects, further include a winding portion that winds the recorded medium; and a control unit that controls the transportation belt, the washing portion, and the winding portion in accordance with a transportation mode selected by the selection unit.

A method for transporting a recorded medium according to a ninth aspect of the invention is a transportation method for use in a recording apparatus including a transportation belt for transporting the recorded medium and a washing portion for washing the transportation belt, and includes selecting a transportation mode for transporting the recorded medium from among a washing transportation mode in which the transportation belt is transported while being washed by the washing portion, and a non-washing transportation mode in which the transportation belt is transported without being washed by the washing portion.

According to the above aspects of the invention, in a recording apparatus including a transportation belt for transporting a recorded medium and a washing portion for washing the transportation belt, the recorded medium can be transported in various transportation modes.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described with reference to the drawings.

Figure 1:
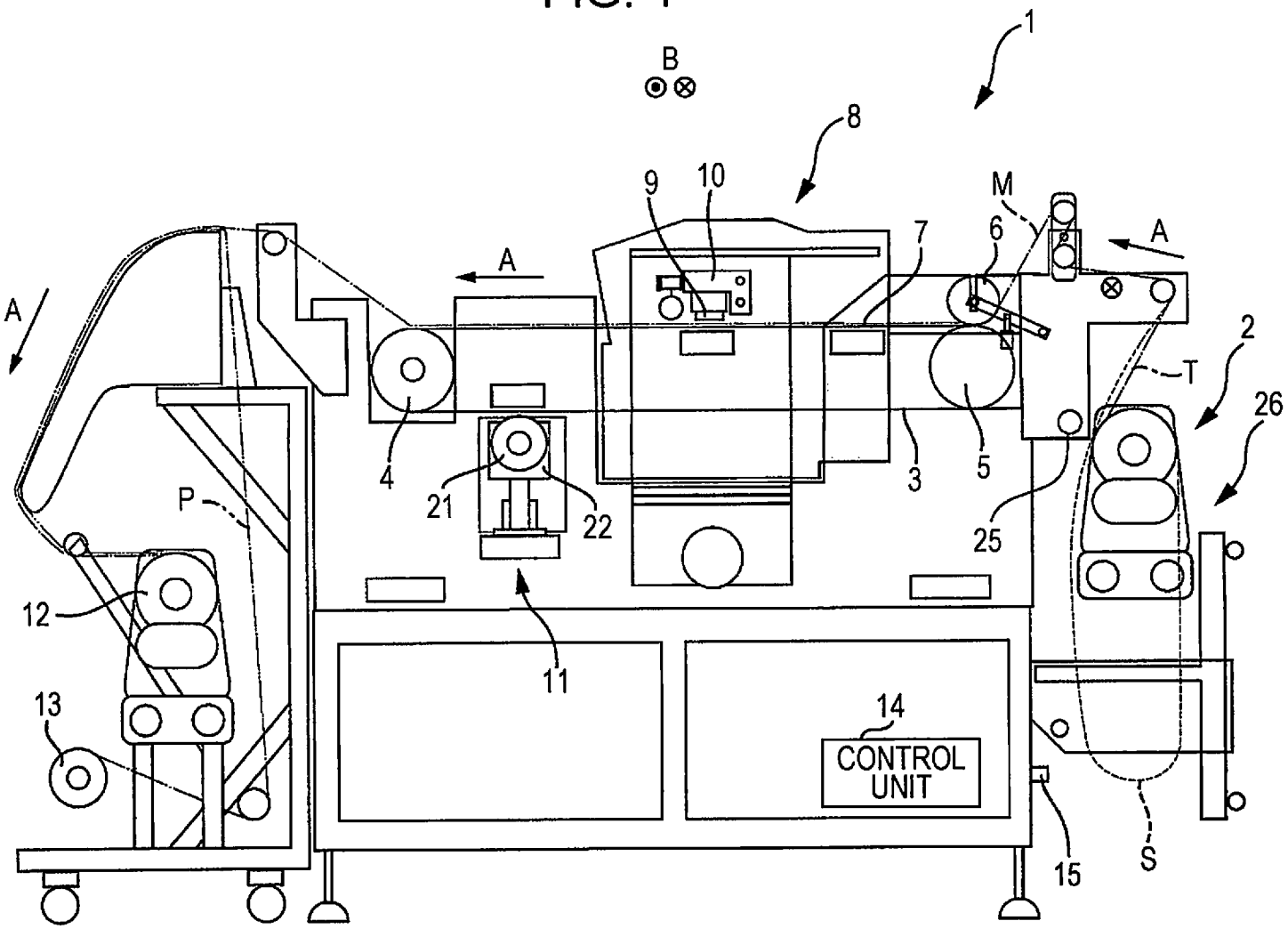
FIG. 1 is a schematic side view of a recording apparatus according to an embodiment of the invention.
Figure 2:
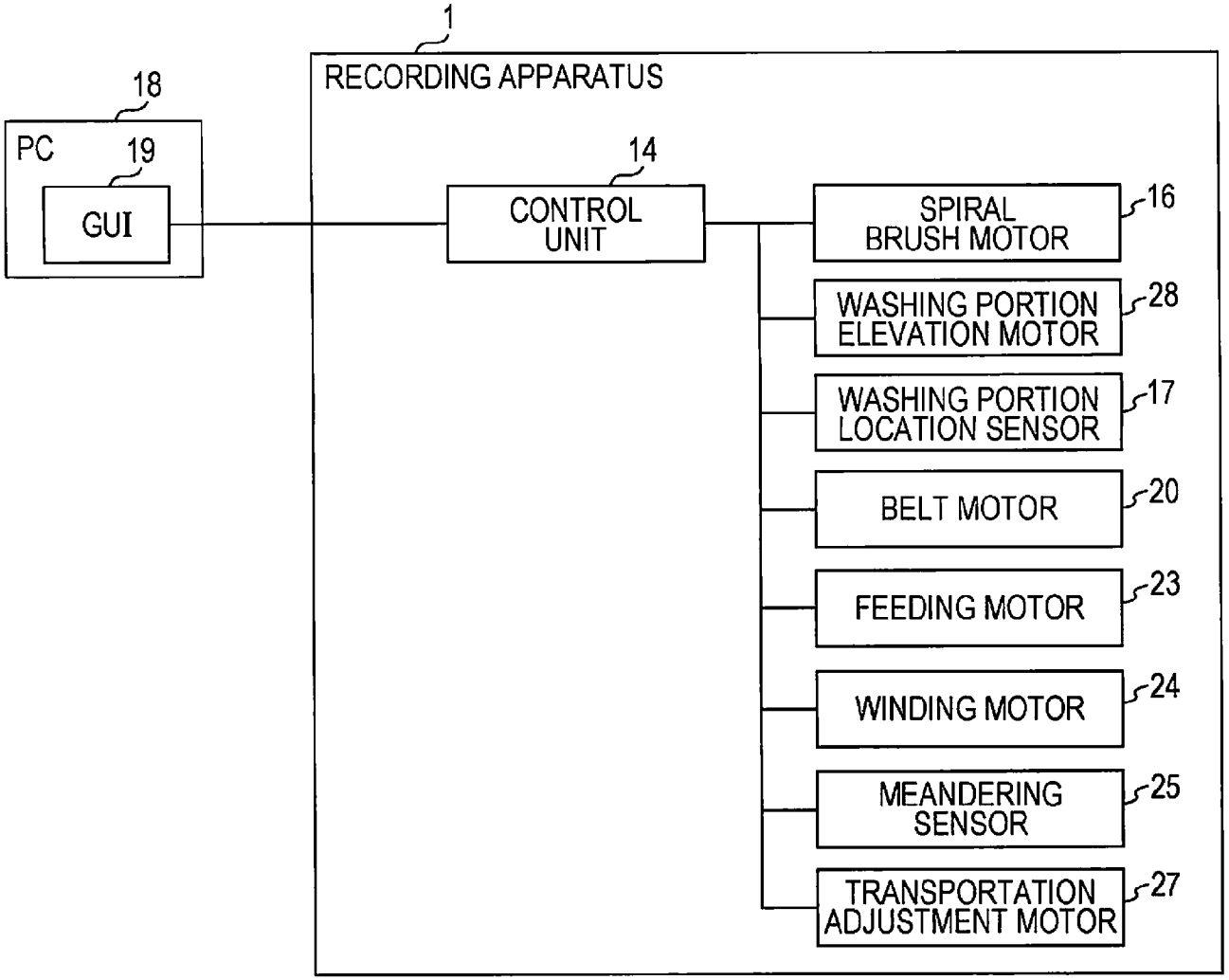
FIG. 2 is a block diagram of a recording apparatus according to an embodiment of the invention.
Figure 3:
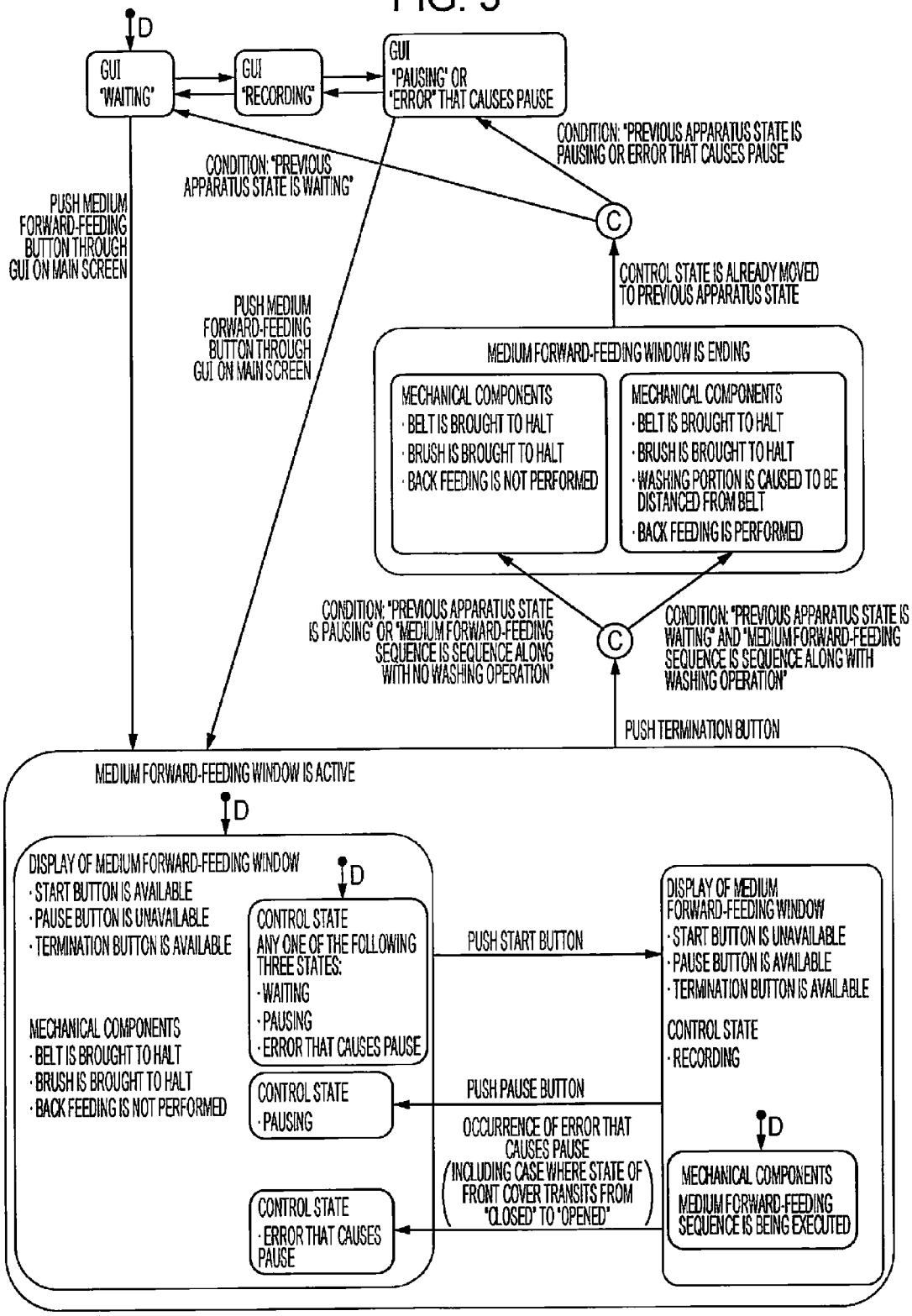
FIG. 3 is a state transition diagram of a recording apparatus according to an embodiment of the invention.

Embodiment of Recording Apparatus (FIGS. 1 to 3)

FIG. 1 is a schematic side view of a recording apparatus 1 according to an embodiment of the invention.

The recording apparatus 1 of this embodiment includes a feeding portion 2 which rotates a recorded medium M, which is wound in a roll state, and thereby feeds the recording medium M. The feeding portion 2 of this embodiment is capable of feeding the recorded medium M to a transportation belt 3 through two kinds of feeding paths, one being a tensioned feeding path T through which the recorded medium M is fed in a tensioned state, the other one being a slack feeding path S through which the recorded medium M is fed in a slack state.

The recording apparatus 1 of this embodiment includes a slack sensor 15 which, when the recorded medium M is fed to the transportation belt 3 in a slack state, detects whether or not an amount of slack of the recorded medium M is larger than or equal to a predetermined amount of slack. In addition, the slack sensor 15 is an optical sensor capable of detecting whether or not the recorded medium M exists at a predetermined position, but a sensor of type different from such an optical sensor of this embodiment may be employed.

Further, the recording apparatus 1 of this embodiment also includes a meandering sensor 25 which detects whether or not the recorded medium M is transported while meandering, and a transportation adjustment portion 26 is capable of restricting the meandering of the recorded medium M by controlling a position of the feeding portion 2 (this position being a position in a direction B shown in FIG. 1) in accordance with a result of the detection by the meandering sensor 25. In addition, the meandering sensor 25 is an optical sensor capable of detecting whether or not the recorded medium M exists at a predetermined position, but a sensor of type different from such an optical sensor of this embodiment may be employed.

The transportation belt 3 of this embodiment is an endless belt being hung in a tensioned state across between driving rollers 4 and 5, and has a supporting face 7 which supports the recorded medium M and on which an adhesive agent is applied.

Further, a pressurizing roller 6 is disposed at a position facing the driving roller 5, and the recorded medium M having been fed from the feeding portion 2 is stuck fast to the supporting face 7 of the transportation belt 3 by being pressed to the side of the transportation belt 3 by the pressurizing roller 6. Further, the recorded medium M having been stuck fast to the supporting face 7 of the transportation belt 3 is transported in a transportation direction A by a rotation movement of the transportation belt 3, caused by a driving force of the driving roller 4.

Further, a recording portion 8 is disposed at a position facing the supporting face 7 of the transportation belt 3 in a transportation path of the recorded medium M. The recording portion 8 includes a recording head 9 from which inks are discharged onto the recorded medium M, and a carriage 10 on which the recording head 9 is mounted and which reciprocates in the direction B intersecting with the transportation direction A.

The recording portion 8 of this embodiment performs printing in conjunction with reciprocation movements, that is, sets of forward and backward movements, of the recording head 9 in the direction B. While a printing operation is performed, during the forward movement of the recording head 9 in the direction B, the transportation belt 3 is in a halt state, and upon completion of the forward movement of the recording head 9 in the direction B, the transportation belt 3 moves for a predetermined distance, and then, enters a halt state again. Moreover, during a period when the transportation belt 3 is in a halt state after the movement for a predetermined distance, the recording head 9 performs the backward movement in the direction B. That is, the transportation belt 3 of this embodiment intermittently moves in conjunction with the reciprocation movements, that is, the sets of forward and backward movements, of the recording head 9 in the direction B.

In addition, the recording apparatus 1 of this embodiment includes the recording head 9 which performs printing while performing reciprocating movements, but may be a recording apparatus including a so-called line head provided with a plurality of nozzles which are arrayed in the direction B intersecting with the transportation direction A and through which inks are discharged.

Here, the "line head" is a recording head for use in a recording apparatus, in which an area of nozzles formed in the direction B intersecting with the transportation direction A of the recorded medium M is provided such that the area of the nozzles is capable of covering the whole of an area extending in the direction B and existing on the recorded medium M, and which forms an image by fixing one of the recording head and the recorded medium M, and moving the other one of the recording head and the recorded medium M. In addition, the area of the nozzles which are formed on the line head so as to extend in the direction B may not be capable of covering the whole of an area extending in the direction B and existing on each of all types of the recorded medium M which are for use in the recording apparatus.

In addition, the recording apparatus 1 of this embodiment is configured to be capable of recording up to the edge portions of the recorded medium M in a width direction of the recorded medium M (i.e., in the direction B), and when the recording apparatus 1 performs printing on the edge portions of the recorded medium M, inks discharged from the recording head 9 are likely to be adhered to the transportation belt 3. Thus, the recording apparatus 1 of this embodiment is provided with the washing portion 11 capable of washing the transportation belt 3 to which inks are adhered.

The washing portion 11 includes a spiral brush 21, and a washing fluid tank 22 capable of allowing washing fluid to be adhered to the spiral brush 21. Further, the washing portion 11 includes a washing portion elevation motor 28 (refer to FIG. 2), and thus, is capable of moving in a direction in which the washing portion 11 comes to a contact with the transportation belt 3 as well as in a direction in which the washing portion 1 becomes distanced from the transportation belt 3.

The recorded medium M on which recording has been performed by the recording head 9 is wound by a winding portion 12. Further, the recording apparatus 1 of this embodiment is configured to be capable of winding the recorded medium M such that, in order to prevent set-off of ink, a sheet of roll paper P is sandwiched between every two adjacent turns of the recorded medium M having been wound by the winding portion 12. The winding of the recorded medium M such that a sheet of the roll paper P is sandwiched between every two adjacent turns of the wound recorded medium M can be achieved by setting the roll paper P in a roll paper feeding portion 13; placing a sheet of the roll paper P along a face opposite a recorded face of the recorded medium M which is in the state of being transported from the transportation belt 3 to the winding portion 12; and allowing the recorded medium M and the sheet of the roll paper P to be wound together with each other by the winding portion 12.

Further, the recording apparatus 1 of this embodiment is provided with a control unit 14 which includes components, such as a CPU which performs control of the whole of the recording apparatus 1, a ROM in which various control programs executed by the CPU, and the like, are stored, a RAM in which pieces of data can be temporarily stored. Further, the control unit 14 performs drive control of individual constituent members included in a driving system of the recording apparatus 1.

Next, an electric configuration of the recoding apparatus 1 of this embodiment will be described.

FIG. 2 is a block diagram of the recording apparatus 1 according to this embodiment.

The recording apparatus 1 of this embodiment includes the control unit 14. The control unit 14 is electrically connected to a spiral brush motor 16 which is a driving source for rotation-driving the spiral brush 21; a washing portion elevation motor 28 which is a driving source for driving the washing portion 11 to move in a direction in which the washing portion 11 comes to a contact with the transportation belt 3 as well as in a direction in which the washing portion 11 becomes distanced from the transportation belt 3; and a washing portion location sensor 17 which detects a location of the washing portion 11. Moreover, the control unit 14 is electrically connected to individual constituent members included in the driving system of the recording apparatus 1, such as a belt motor 20 which is a driving source of the driving roller 4 for rotation-driving the transportation belt 3; a feeding motor 23 which is a driving source of the feeding portion 2; a winding motor 24 which is a driving source of the winding portion 12; the meandering sensor 25; and a transportation adjustment motor 27 which is a driving source of the transportation adjustment portion 26.

Further, the control unit 14 is capable of being communicably connected to a PC 18, which is an external apparatus, via an interface (not illustrated), and is configured to be capable of receiving instructions from a user via a graphic user interface (GUI) 19 of the PC 18.

Through this configuration, the control unit 14 is capable of performing drive control of the constituent members included in the driving system of the recording apparatus 1, such as the spiral brush motor 16, the washing portion elevation motor 28, the washing portion location sensor 17, the belt motor 20, the feeding motor 23, the winding motor 24, the meandering sensor 25, and the transportation adjustment motor 27, on the basis of instructions input by a user through the GUI 19.

Further, in the recording apparatus 1 of this embodiment, programs each associated with a corresponding one of a plurality of transportation modes in which the recorded medium M is transported are stored in the ROM of the control unit 14. Further, these programs enable the recorded medium M to be transported in various transportation modes.

Specifically, there are provided two transportation modes, one being a washing transportation mode in which the transportation belt 3 is transported while being washed by the washing portion 11, the other one being a non-washing transportation mode in which the transportation belt 3 is transported without being washed by the washing portion 11.

Moreover, there are also provided two transportation modes each of which is executable in combination with any one of the washing transportation mode and the non-washing transportation mode: one of the two transportation modes being a tensioned-medium transportation mode in which the recorded medium M is transported in a tensioned state; the other one of the two transportation modes being a slack-medium transportation mode in which the recorded medium M is transported in a slack state.

Furthermore, there are also provided two transportation modes each of which is executable in combination with any one of the washing transportation mode and the non-washing transportation mode and further any one of the tensioned-medium transportation mode and the slack-medium transportation mode: one of the two transportation modes being a transportation adjustment mode in which a transportation direction is adjusted by the transportation adjustment portion 26; the other one of the two transportation modes being a non-transportation adjustment mode in which the transportation direction is not adjusted by the transportation adjustment portion 26.

As described above, the recording apparatus 1 of this embodiment includes the transportation belt 3 for transporting the recorded medium M and the washing portion 11 for washing the transportation belt 3. Further, the control unit 14 has a roll of selecting a transportation mode for transporting the recorded medium M from among the washing transportation mode in which the transportation belt 3 is transported while being washed by the washing portion 11 and the non-washing transportation mode in which the transportation belt 3 is transported without being washed by the washing portion 11.

Through such a configuration, the recording apparatus 1 of this embodiment is capable of, when performing frameless recording, selecting the washing transportation mode because the transportation belt 3 becomes soiled. Further, the recording apparatus 1 is capable of, when performing recording in a recording mode in which the transportation belt 3 does not become soiled, selecting the non-washing transportation mode. Accordingly, the recording apparatus 1 is configured to be capable of transporting the recorded medium M in various transportation modes.

Further, the control unit 14 of this embodiment is configured to, as a transportation mode to be selected when, after a recording operation onto the recorded medium M has been brought to a halt, the recorded medium M is transported along with no printing operation, select the washing transportation mode or the non-washing transportation mode, whichever has been selected in the printing operation having been brought to a halt.

When, after a recording operation onto the recorded medium M has been brought to a halt, the recorded medium M is transported along with no printing operation, if the recorded medium M is transported in a transportation mode different from a transportation mode which has been selected in the printing operation having been brought to a halt, a failure is likely to occur. For example, if, after a recording operation has been performed in the washing transportation mode, the recorded medium M is transported along with no printing operation in the non-washing transportation mode, a situation in which the recorded medium M is transported in a state in which an unwashed portion remains left on the transportation belt 3 is likely to occur. When the recorded medium M is transported in a state in which an unwashed portion remains left on the transportation belt 3, the recorded medium M is likely to become soiled.

In this regard, however, the control unit 14 of this embodiment is configured to, as a transportation mode to be selected when, after a recording operation onto the recorded medium M has been brought to a halt, the recorded medium M is transported along with no printing operation, select the washing transportation mode or the non-washing transportation mode, whichever has been selected in the printing operation having been brought to a halt. Thus, the control unit 14 prevents the occurrence of a failure due to transportation of the recorded medium M in a transportation mode different from a transportation mode which has been selected in the recording operation having been brought to a halt.

In addition, the above situation in which a recording operation is brought to a halt encompasses, in addition to a situation in which a recording operation is brought to a pause upon reception of an instruction from the GUI 19 or the like, a situation in which a recording operation is brought to a pause because of the occurrence of an error, and a situation in which the recording apparatus 1 is in a waiting state after the completion of recording of a series of pieces of recording data having been input from the PC 18.

Further, as described above, the recording apparatus 1 of this embodiment includes the feeding portion 2 for feeding the recorded medium M to the transportation belt 3.

Further, there are provided two transportation modes each of which is executable in combination with any one of the washing transportation mode and the non-washing transportation mode: one of the two transportation modes being a tensioned-medium transportation mode in which the recorded medium M fed from the feeding portion 2 to the transportation belt 3 is transported in a tensioned state; the other one of the two transportation modes being a slack-medium transportation mode in which the recorded medium M fed from the feeding portion 2 to the transportation belt 3 is transported in a slacked state.

Thus, the recorded medium M can be transported in various transportation modes.

In addition, in the recording apparatus 1 of this embodiment, each of the washing transportation mode and the non-washing transportation mode is executable in combination with any one of the slack-medium transportation mode and the tensioned-medium transportation mode, but the recording apparatus 1 may be configured such that at least one of the washing transportation mode and the non-washing transportation mode is executable in combination with any one of the slack-medium transportation mode and the tensioned-medium transportation mode.

Further, as described above, the recording apparatus 1 of this embodiment includes the transportation adjustment portion 26 for adjusting a transportation direction of the recorded medium M.

Further, there are provided two transportation modes each of which is executable in combination with any one of the washing transportation mode and the non-washing transportation mode and further any one of the tensioned-medium transportation mode and the slack-medium transportation mode: one of the two transportation modes being a transportation adjustment mode in which a transportation direction is adjusted by the transportation adjustment portion 26; the other one of the two transportation modes being a non-transportation adjustment mode in which the transportation direction is not adjusted by the transportation adjustment portion 26. Thus, the recorded medium M can be transported in various transportation modes.

In addition, in the recording apparatus 1 of this embodiment, each of the washing transportation mode and the non-washing transportation mode, as well as each of the tensioned-medium transportation mode and the slack-medium transportation mode, is executable in combination with any one of the transportation adjustment mode and the non-transportation adjustment mode, but the recording apparatus 1 may be configured such that at least one of the washing transportation mode and the non-washing transportation mode, as well as at least one of the tensioned-medium transportation mode and the slack-medium transportation mode, is executable in combination with any one of the transportation adjustment mode and the non-transportation adjustment mode.

Further, as described above, the recording apparatus 1 of this embodiment includes the winding portion 12 for winding the recorded medium M.

Further, the control unit 14 is capable of performing interlock control for interlocking the transportation belt 3, the washing portion 11, the feeding portion 2, the transportation adjustment portion 26, and the winding portion 12 in accordance with a transportation mode selected by the control unit 14 itself.

Thus, for example, when the washing transportation mode is selected, it is possible to save a user the trouble of individually operating the transportation belt 3, the washing portion 11, the feeding portion 2, the transportation adjustment portion 26, and the winding portion 12.

Here, the above "interlock control" means to perform control so as to automatically cause the individual constituent members to be interlocked in a selected transportation mode, without causing a user to perform individual operations of the constituent members.

In addition, the above "operations" mean, for example, changing of the positions of the individual constituent members, wiping out of soiled portions on the individual constituent members, and the like.

In addition, the recording apparatus 1 of this embodiment is capable of performing interlock control for interlocking the transportation belt 3, the washing portion 11, the feeding portion 2, the transportation adjustment portion 26, and the winding portion 12 in accordance with a transportation mode selected by the control unit 14, but the recording apparatus 1 may be configured to be capable of performing the interlock control for interlocking not all of the above constituent members, but two or more of the above constituent members.

In addition, a method for transporting the recorded recording medium M may be changed for each transportation mode. For example, intermittent transportation may be used in the washing transportation mode, and continuous transportation may be used in the non-washing transportation mode.

Further, it is preferable to set, for each transportation mode, a speed of transporting the recorded medium M in view of a speed of feeding the recorded medium M in the feeding portion 2 and a speed of winding the recorded medium M in the winding portion 12.

Next, a state transition in the recording apparatus 1 of this embodiment will be described.

FIG. 3 is a state transition diagram of the recording apparatus 1 of this embodiment. In FIG. 3, a point C denotes a conditional branch point, and a point D denotes a start point in a transition state.

Any one of indications of "waiting", "recording", "pausing", and "error" which causes a pause is displayed on a main window of the GUI 19 of the PC 18 so as to correspond to a state of the recording apparatus 1.

When, in the state in which, among these indications, anyone of indications of "waiting", "pausing", and "error" which causes a pause, is displayed, a medium forward-feeding button displayed on the main window of the GUI 19 is pushed, a medium forward-feeding window becomes active.

When the medium forward-feeding window has become active, as an initial screen of the medium forward-feeding window, a start button corresponding to a start of transportation of the recorded medium M, a pause button corresponding to a halt of transportation of the recorded medium M, and a termination button corresponding to a termination of transportation of the recorded medium M are displayed in a state in which the start button and the termination button are each available and the pause button is unavailable.

In addition, while this initial screen is displayed, among the constituent members (mechanical components) of the recording apparatus 1, the transportation belt 3 and the spiral brush 21 of the washing portion 11 are each in a halt state, and transportation of the recorded medium M in a direction inverse to the transportation direction A (i.e., back feeding) is not performed.

When the start button is pushed on the medium forward-feeding window, the transportation of the recorded medium M is started (at this time, a control state is, for example, a recording state), and, simultaneously therewith, the display of the initial screen is updated to a display indicating that the start button is unavailable, and the pause button and the termination button are each available.

When, in this state, the pause button is pushed, a control state of the mechanical components enters a pause state.

Further, when, in this state, an error that causes a pause is caused by, for example, an event in which a front cover of the recording apparatus 1 is opened, the control state of the mechanical components enters a state in which an error that causes a pause is occurring (in a pause state). In this regard, however, in the case where the recorded medium M is transported along with no recording operation, the control state may be caused to enter a state other than the state in which an error that causes a pause is occurring. This is because, in this case, there is no movement of the carriage 10, and thus, a situation in which a user comes into contact with the carriage 10 does not occur.

Further, when the termination button is pushed on the medium forward-feeding window, a "medium forward-feeding window ending window", which indicates that the transportation of the recorded medium M is being terminated, is opened. In addition, in this case, a close button for closing the medium forward-feeding window is unavailable.

Here, in the case where a state of the recording apparatus 1 before the push of the termination button (i.e., a previous apparatus state) is a pausing state or a state in which the recorded medium M is transported in the non-washing transportation mode (i.e., a state in which a medium forward-feeding sequence is a sequence along with no washing operation), the transportation belt 3 and the spiral brush 21 of the washing portion 11 among the mechanical components are each brought to a halt. In addition, back feeding is not performed.

Meanwhile, in the case where a state of the recording apparatus 1 before the push of the termination button is a waiting state or a state in which the recorded medium M is transported in the washing transportation mode (i.e., a state in which the medium forward-feeding sequence is a sequence along with a washing operation), the transportation belt 3 and the spiral brush 21 of the washing portion 11 among the mechanical components are each brought to a halt; the washing portion 11 is caused to be distanced from the transportation belt 3; and back feeding is performed. In addition, the purpose of this back feeding is to prevent the occurrence of an unwashed portion on the transportation belt 3 due to a displacement of a contact portion between the transportation belt 3 and the washing portion 11, which is caused by one operation of causing the transportation belt 3 and the washing portion 11 to be distanced from each other. Through execution of the back feeding, it becomes possible to prevent the occurrence of an unwashed portion due to a displacement of the contact portion.

Further, when the control state of the mechanical components has moved to a previous apparatus state, an indication of "waiting", "pausing", or "error" that causes a pause, whichever corresponds to the previous apparatus state, is displayed on the main window.

Figure 4:
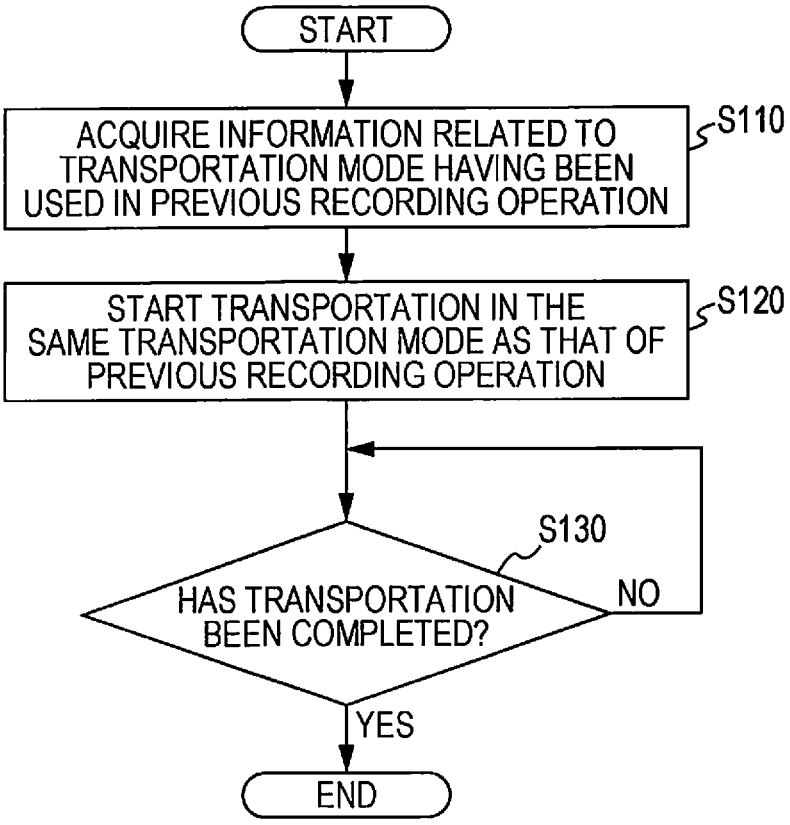
FIG. 4 is a flowchart of a method for transporting a recorded medium, according to an embodiment of the invention.

Embodiment of Method for Transporting Recorded Medium (FIG. 4)

Next, an embodiment of a method for transporting the recorded medium M, in which the recording apparatus 1 of the aforementioned embodiment is used, will be described.

FIG. 4 is a flowchart of a method for transporting the recorded medium M, according to this embodiment.

When a method for transporting the recorded medium, according to this embodiment, is started, first, in step S110, the control unit 14 acquires a piece of information related to a transportation mode in a previous recording operation.

Speaking in detail, the control unit 14 acquires a piece of information indicating which of the washing transportation mode and the non-washing transportation mode is included in a transportation mode of a previous recording operation; which of the slack-medium transportation mode and the tensioned-medium transportation mode is included in the transportation mode of the previous recording operation; and which of the transportation adjustment mode and the non-transportation adjustment mode is included in the transportation mode of the previous recording operation.

Further, in step S120, the recording apparatus 1 starts transporting of the recorded medium M in the same transportation mode as that of the previous recording operation.

That is, the recording apparatus 1 starts transporting of the recorded medium M by causing the control unit 14 to, in accordance with the piece of information having been acquired in step S110, perform interlock control for interlocking the transportation belt 3, the washing portion 11, the feeding portion 2, the transportation adjustment portion 26, and the winding portion 12.

Further, in step S130, the operation of transporting the recorded medium M is continued until a determination of the completion of the operation of transporting the recorded medium M, and simultaneously with the completion thereof, the method for transporting the recorded medium M, according to this embodiment, ends.

It can be said from the above description that the method for transporting the recorded medium M, according to this embodiment, is a method for transporting the recorded medium M for use in the recording apparatus 1 including the transportation belt 3 for transporting the recorded medium M and the washing portion 11 for washing the transportation belt 3, and includes selecting a transportation mode for transporting the recorded medium M from among the washing transportation mode in which the transportation belt 3 is transported while being washed by the washing portion 11, and the non-washing transportation mode in which the transportation belt 3 is transported without being washed by the washing portion 11.

Thus, for example, it is possible to, when frameless recording is performed, select the washing transportation mode because the transportation belt 3 becomes soiled. Further, it is possible to, when performing recording in a recording mode in which the transportation belt 3 does not become soiled, select the non-washing transportation mode. Accordingly, it is possible to transport the recorded medium M in various transportation modes.

In addition, the invention is not limited to the aforementioned embodiments. Further, various modification can be made on the invention within a scope of the invention set forth in the appended claims, and obviously, the modifications are included in the scope of the invention.

Hereinbefore, the invention has been described in detail on the basis of the specific embodiments. Here, the invention will be described once again in a summarized manner.

A recording apparatus 1 according to a first aspect of the invention includes a transportation belt 3 that transports a recorded medium M; a washing portion 11 that washes the transportation belt 3; and a selection unit (control unit) 14 that selects a transportation mode for transporting the recorded medium M from among a washing transportation mode in which the transportation belt 3 is transported while being washed by the washing portion 11, and a non-washing transportation mode in which the transportation belt is transported without being washed by the washing portion 11.

The recording apparatus 1 according to the first aspect includes the selection unit 14 that selects a transportation mode for transporting the recorded medium M from among the washing transportation mode and the non-washing transportation mode. Thus, the recording apparatus 1 according to the first aspect is capable of, when performing frameless recording, selecting the washing transportation mode because the transportation belt 3 becomes soiled. Further, the recording apparatus 1 according to the first aspect is capable of, when performing recording in a recording mode in which the transportation belt 3 does not become soiled, selecting the non-washing transportation mode. Accordingly, the recording apparatus 1 according to the first aspect is capable of transporting the recorded medium M in various transportation modes.

A recording apparatus 1 according to a second aspect of the invention is configured to, in the above first aspect, further include a control unit 14 that controls the transportation belt 3 and the washing portion 11 in accordance with a transportation mode selected by the selection unit 14.

In the recording apparatus 1 according to the second aspect, the control unit 14 controls the transportation belt 3 and the washing portion 11 in accordance with a transportation mode selected by the selection unit 14. Thus, for example, in the case where the selection unit 14 selects the washing transportation mode, it becomes possible to save a user the trouble of individually operating the transportation belt 3 and the washing portion 11. In addition, the above "operation" means, for example, changing of the positions of the individual constituent members, wiping out of soiled portions on the individual constituent members, and the like. Further, not only the configuration of the recording apparatus 1 according to the second aspect, in which the control unit 14 and the selection unit 14 are separately provided, but also a configuration, just like the configuration of the recording apparatus 1 of the aforementioned embodiment, in which the control unit 14 also operates as the selection unit 14, may be employed.

A recording apparatus 1 according to a third aspect of the invention is configured such that, in each of the above first and second aspects, the selection unit 14 selects, as a transportation mode for use in transporting the recorded medium M along with no recording operation after a recording operation onto the recorded medium M has been brought to a halt, the washing transportation mode or the non-washing transportation mode, whichever has been selected in the recording operation having been brought to a halt.

When, after a recording operation onto the recorded medium M has been brought to a halt, the recorded medium M is transported along with no printing operation, if the recorded medium M is transported in a transportation mode different from a transportation mode which has been selected in the printing operation having been brought to a halt, a failure is likely to occur. For example, if, after a recording operation has been performed in the washing transportation mode, the recorded medium M is transported along with no printing operation in the non-washing transportation mode, a situation in which the recorded medium M is transported in a state in which an unwashed portion remains left on the transportation belt 3 is likely to occur. When the recorded medium M is transported in a state in which an unwashed portion remains left on the transportation belt 3, the recorded medium M is likely to become soiled.

In the recording apparatus 1 according to the third aspect, the control unit 14 is configured to, as a transportation mode to be selected when, after a recording operation onto the recorded medium M has been brought to a holt, the recorded medium M is transported along with no printing operation, select the washing transportation mode or the non-washing transportation mode, whichever has been selected in the printing operation having been brought to a halt. Thus, the recording apparatus 1 according to the third aspect is capable of preventing the occurrence of a failure due to transportation of the recorded medium M in a transportation mode different from a transportation mode which has been selected in the recording operation having been brought to a halt. In addition, the above situation in which a recording operation is brought to a halt encompasses, in addition to a situation in which a recording operation is brought to a pause upon reception of an instruction from a user, a situation in which a recording operation is brought to a pause because of the occurrence of an error, and a situation in which the recording apparatus 1 is in a waiting state after the completion of recording of a series of pieces of recording data having been input to the recording apparatus 1.

A recording apparatus 1 according to a fourth aspect of the invention is configured to, in each of the above first to third aspects, further include a feeding portion 2 that feeds the recorded medium M to the transportation belt 3, and allow at least one of the washing transportation mode and the non-washing mode to be executed in combination with any one of two kinds of transportation modes, one being a slack-medium transportation mode in which the recorded medium M, which is fed from the feeding portion 2 to the transportation belt 3, is transported in a slack state, the other one being a tensioned-medium transportation mode in which the recorded medium M, which is fed from the feeding portion 2 to the transportation belt 3, is transported in a state in which a tensile force is applied to the recorded medium M.

In the recording apparatus 1 according to the fourth aspect, at least one of the washing transportation mode and the non-washing transportation mode is executable in combination with any one of the slack-medium transportation mode and the tensioned-medium transportation mode. Accordingly, the recording apparatus 1 according to the fourth aspect is capable of transporting the recorded medium M in various transportation modes.

A recording apparatus 1 according to a fifth aspect of the invention is configured to, in the above fourth aspect, further include a control unit 14 that controls the transportation belt 3, the washing portion 11, and the feeding portion 2 in accordance with a transportation mode selected by the selection unit 14.

In the recording apparatus 1 according to the fifth aspect, the control unit 14 controls the transportation belt 3, the washing portion 11, and the feeding portion 2 in accordance with a transportation mode selected by the selection unit 14. Thus, for example, in the case where the selection unit 14 selects the washing transportation mode, it becomes possible to save a user the trouble of individually operating the transportation belt 3, the washing portion 11, and the feeding portion 2.

A recording apparatus 1 according to a sixth aspect of the invention is configured to, in any one of the above first to fifth aspects, further include a transportation adjustment portion 26 that adjusts a transportation direction of the recorded medium M, and allow at least one of the washing transportation mode and the non-washing transportation mode to be executed in combination with any one of two kinds of transportation modes, one being a transportation adjustment mode in which the transportation direction is adjusted by the transportation adjustment portion 26, the other one being a non-transportation adjustment mode in which the transportation direction is not adjusted by the transportation adjustment portion 26.

In the recording apparatus 1 according to the sixth aspect, at least one of the washing transportation mode and the non-washing transportation mode is executable in combination with any one of the transportation adjustment mode and the non-transportation adjustment mode. Accordingly, the recording apparatus 1 according to the sixth aspect is capable of transporting the recorded medium M in various transportation modes.

A recording apparatus 1 according to a seventh aspect of the invention is configured to, in the above sixth aspect, further include a control unit 14 that controls the transportation belt 3, the washing portion 11, and the transportation adjustment portion 26 in accordance with a transportation mode selected by the selection unit 14.

In the recording apparatus 1 according to the seventh aspect, the control unit 14 controls the transportation belt 3, the washing portion 11, and the transportation adjustment portion 26 in accordance with a transportation mode selected by the selection unit 14. Thus, for example, in the recording apparatus 1 which further includes the feeding portion 2 which is controllable just like the recording apparatus 1 of the aforementioned embodiment, in the case where the selection unit 14 selects the washing transportation mode, it becomes possible to save a user the trouble of individually operating the transportation belt 3, the washing portion 11, the feeding portion 2, and the transportation adjustment portion 26.

A recording apparatus 1 according to an eighth aspect of the invention is configured to, in any one of the above first to seventh aspects, further include a winding portion 12 that winds the recorded medium M; and a control unit 14 that controls the transportation belt 3, the washing portion 11, and the winding portion 12 in accordance with a transportation mode selected by the selection unit 14.

In the recording apparatus 1 according to the seventh aspect, the control unit 14 controls the transportation belt 3, the washing portion 11, and the winding portion 12 in accordance with a transportation mode selected by the selection unit 14. Thus, for example, in the recording apparatus 1 which further includes the feeding portion 2 and the transportation adjustment portion 26 which are controllable just like the recording apparatus 1 of the aforementioned embodiment, in the case where the selection unit 14 selects the washing transportation mode, it becomes possible to save a user the trouble of individually operating the transportation belt 3, the washing portion 11, the feeding portion 2, the transportation adjustment portion 26, and the winding portion 12.

A method for transporting a recorded medium M according to a ninth aspect of the invention is a transportation method for use in a recording apparatus 1 including a transportation belt 3 for transporting the recorded medium M and a washing portion 11 for washing the transportation belt 3, and includes selecting a transportation mode for transporting the recorded medium M from among a washing transportation mode in which the transportation belt 3 is transported while being washed by the washing portion 11, and a non-washing transportation mode in which the transportation belt 3 is transported without being washed by the washing portion 11.

In the method for transporting the recorded medium M according to the ninth aspect, the transportation mode for transporting the recorded medium M is selected from among the washing transportation mode and the non-washing transportation mode. Thus, for example, it is possible to, when frameless printing is performed, select the washing transportation mode because the transportation belt 3 becomes soiled. Further, it is possible to, when recording is performed in a recording mode in which the transportation belt 3 does not become soiled, select the non-washing transportation mode. Accordingly, it is possible to transport the recorded medium M in various transportation modes.

The entire disclosure of Japanese Patent Application No. 2014-57901, filed Mar. 20, 2014 is expressly incorporated by reference herein.

What is claimed is:

1. A recording apparatus comprising:

a transportation belt that transports a recorded medium;

a washing portion that washes the transportation belt; and a selection unit that selects a transportation mode for transporting the recorded medium from among a washing transportation mode in which the transportation belt is transported while being washed by the washing portion, and a non-washing transportation mode in which the transportation belt is transported without being washed by the washing portion, wherein the selection unit selects, as the transportation mode for use in transporting the recorded medium along with no recording operation after a recording operation onto the recorded medium has been brought to a halt, the washing transportation mode or the non-washing transportation mode, whichever has been selected in the recording operation having been brought to a halt.

2. The recording apparatus according to claim 1, further comprising a control unit that controls the transportation belt and the washing portion in accordance with a transportation mode selected by the selection unit.

3. The recording apparatus according to claim 1, further comprising a feeding portion that feeds the recorded medium to the transportation belt, wherein at least one of the washing transportation mode and the non-washing mode is executed in combination with any one of two kinds of transportation modes, one being a slack-medium transportation mode in which the recorded medium, which is fed from the feeding portion to the transportation belt, is transported in a slack state, the other one being a tensioned-medium transportation mode in which the recorded medium, which is fed from the feeding portion to the transportation belt, is transported in a state in which a tensile force is applied to the recorded medium.

4. The recording apparatus according to claim 3, further comprising a control unit that controls the transportation belt, the washing portion, and the feeding portion in accordance with a transportation mode selected by the selection unit.

5. The recording apparatus according to claim 1, further comprising a transportation adjustment portion that adjusts a transportation direction of the recorded medium, wherein at least one of the washing transportation mode and the non-washing transportation mode is executed in combination with any one of two kinds of transportation modes, one being a transportation adjustment mode in which the transportation direction is adjusted by the transportation adjustment portion, the other one being a non-transportation adjustment mode in which the transportation direction is not adjusted by the transportation adjustment portion.

6. The recording apparatus according to claim 5, further comprising a control unit that controls the transportation belt, the washing portion, and the transportation adjustment portion in accordance with a transportation mode selected by the selection unit.

7. The recording apparatus according to claim 1, further comprising:

a winding portion that winds the recorded medium; and a control unit that controls the transportation belt, the washing portion, and the winding portion in accordance with a transportation mode selected by the selection unit.

8. A method for transporting a recorded medium in a recording apparatus including a transportation belt for transporting the recorded medium and a washing portion for washing the transportation belt, the method comprising:

selecting a transportation mode for transporting the recorded medium from among a washing transportation mode in which the transportation belt is transported while being washed by the washing portion, and a non-washing transportation mode in which the transportation belt is transported without being washed by the washing portion, wherein the selecting of the transportation mode includes selecting, as the transportation mode for use in transporting the recorded medium along with no recording operation after a recording operation onto the recorded medium has been brought to a halt, the washing transportation mode or the non-washing transportation mode, whichever has been selected in the recording operation having been brought to a halt.

9. A recording apparatus comprising:

a transportation belt that transports a recorded medium;

a washing portion that washes the transportation belt; and a selection unit that selects a transportation mode for transporting the recorded medium from among a washing transportation mode in which the transportation belt is transported while being washed by the washing portion, and a non-washing transportation mode in which the transportation belt is transported without being washed by the washing portion, wherein the selection unit selects the transportation mode in accordance with a recording mode.

* * * * *